US005140778A

United States Patent [19]

Carruth

[11] Patent Number: 5,140,778

[45] Date of Patent: Aug. 25, 1992

[54] SUPPORT AND STOP FOR HAND HELD SANDER TO CONTROL DEPTH AND ANGLE OF CUT

[76] Inventor: Louis Carruth, 5037 Bissonet Dr., Metairie, La. 70003

[21] Appl. No.: 480,151

[22] Filed: Feb. 14, 1990

[51] Int. Cl.[5] ..... B24B 23/00; B27C 1/10

[52] U.S. Cl. ..... 51/170 R; 51/170 PT; 30/481; 30/485; 30/476; 144/134 D

[58] Field of Search ..... 51/170 R, 205 R, 392, 51/277, 170 PT; 30/481, 484, 485, 487, 478, 475, 476; 144/134 D

[56] References Cited

U.S. PATENT DOCUMENTS

| | | | |
|---|---|---|---|
| 820,639 | 5/1906 | Gabrielson | 30/481 |
| 1,116,158 | 11/1914 | Swain et al. | 51/170 R |
| 2,069,923 | 2/1937 | Olson et al. | 30/478 |
| 2,864,208 | 12/1958 | Ringer | 51/392 |
| 3,148,486 | 9/1964 | Gary et al. | 51/170 R |
| 4,132,254 | 1/1979 | Shochovsky | 144/134 D |
| 4,363,343 | 12/1982 | Cuneo | 30/475 |
| 4,584,772 | 4/1986 | Bergler | 30/475 |

FOREIGN PATENT DOCUMENTS 2216460 10/1989 United Kingdom ..... 51/170 PT

*Primary Examiner*—Roscoe V. Parker

[57] ABSTRACT

A portable wood sander comprising retractable interim fences to support the tool, while sanding, on the surface of an independent supporting structure, other than the surface of the work piece being sanded, and other straddling fences to stop the abrasive cut of the work piece by the sander when a predetermined angle and depth of cut of the top surface of the work piece has been obtained and the straddling fences contact the surface of the said independent supporting structure. The support, control and stop means or fences may be an integral part of the sander or be attachable to said tool or to a previously manufactured sander and may contain means for the fences to be adjustable vertically, horizontally or on an angle, independently or together, in order to obtain a predetermined angle and depth of cut of a work piece by mechanical means. The sander and fences may include gauging or ruling devises to accurately preset the depth and angle of cut of the work piece to be obtained when the cutting action is stopped.

7 Claims, 6 Drawing Sheets

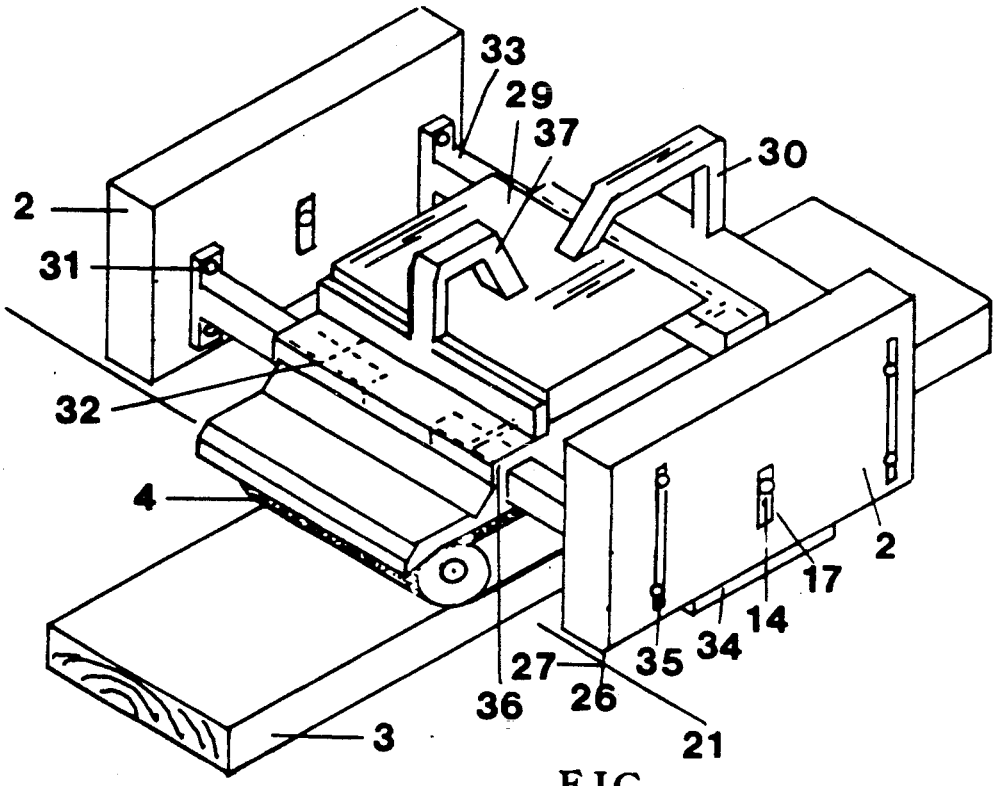
FIG 2
FIG 3
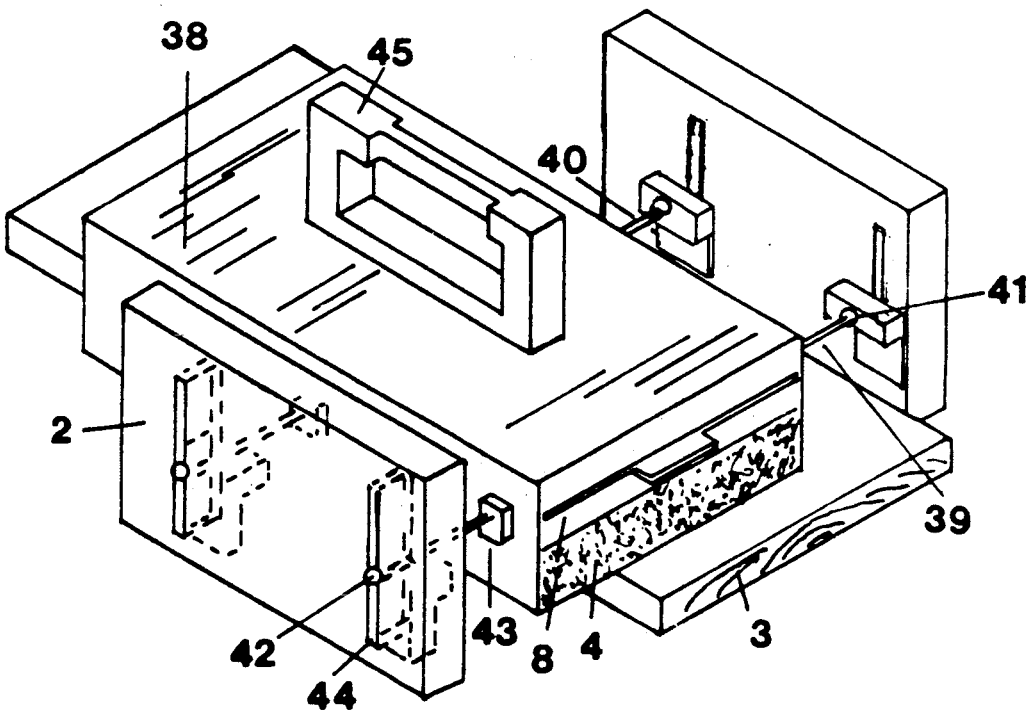

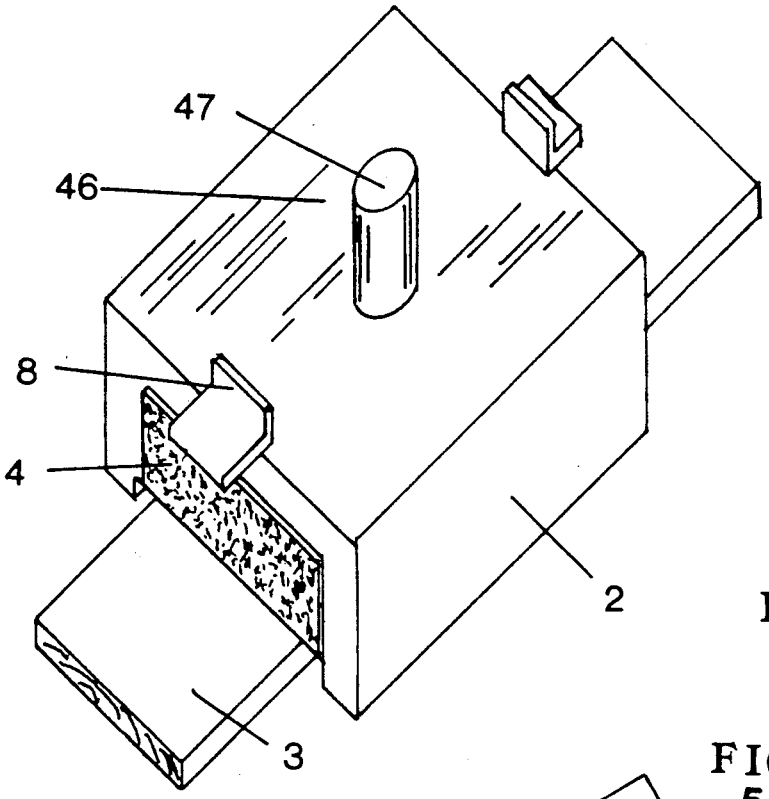
FIG 4
FIG 5
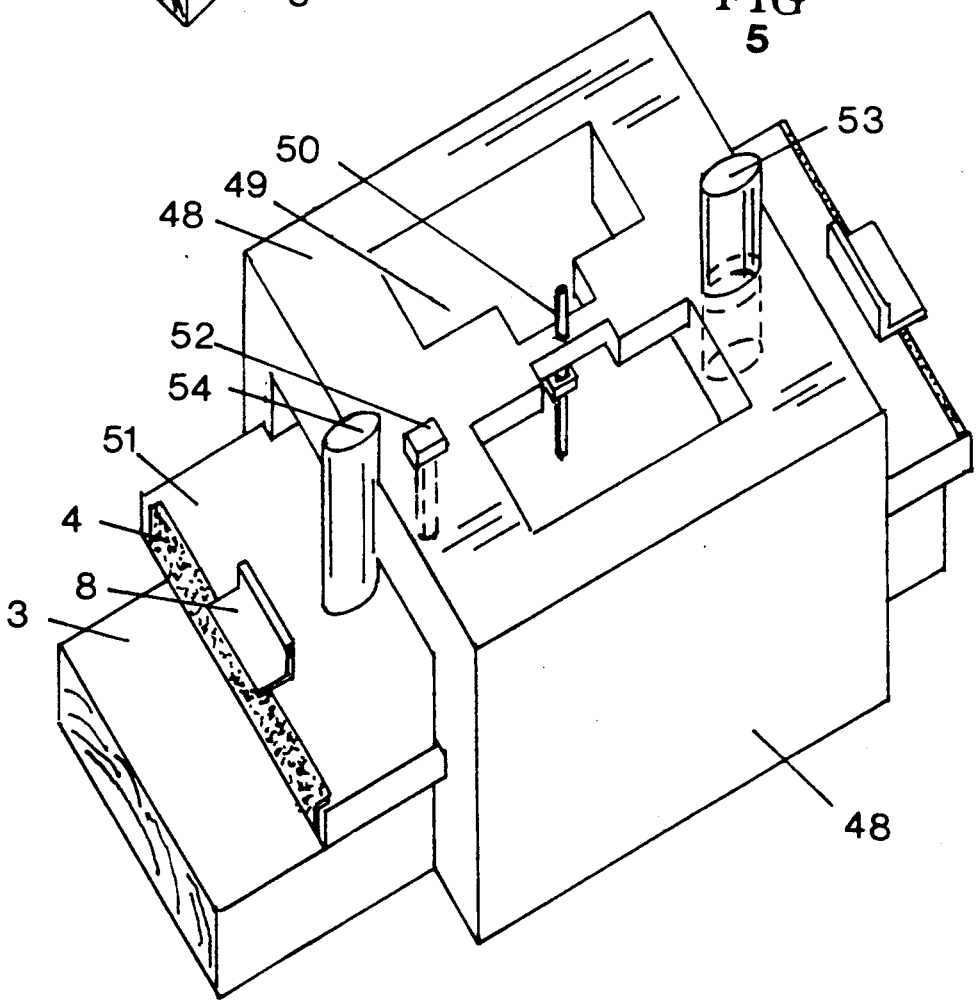

SUPPORT AND STOP FOR HAND HELD SANDER TO CONTROL DEPTH AND ANGLE OF CUT

BACKGROUND

1. Field of Invention

This invention relates to a hand held sander, specifically one having a means to independently support the tool on a surface other than the surface of the work piece being sanded in order to control the tool's angle and depth of cut and one which has a means to limit or stop the cut of said work piece when a predetermined depth and angle of cut is obtained.

2. Description Of Prior Art

Woodworkers frequently sand or plane a piece of wood, a board, a piece of particle board, plywood, veneer or other fibrous material (sometimes hereinafter referred to simply as "board") in order to obtain a smooth surface on the work piece, change its shape or reduce its dimension.

Heretofore, the artisan, to accomplish this purpose, sometimes, sanded the work piece by hand or used a sanding block, a hand held orbital or continuous belt sanding machine.

None of the above described sanding or planing methods or tools now available:

1. have means to limit or stop the depth of cut of the work piece;
2. provide mechanical means to assure that the work piece will be sanded or planed uniformly and be of consistent thickness throughout its length;
3. have adequate means to prevent "valleys" in the surface of the work piece;
4. have mechanical means to assure that the hose of the sander is flat on the work piece to prevent the work piece being "rounded";
5. have means to gauge or measure the extent the sander will be allowed to cut the work piece to obtain a work piece of predetermined accurate measured dimension; and
6. have means to mechanically control the angle the tool will cut the work piece.

Some woodworkers, to smooth the surface or to lightly dimension the "board" use a stationary drum sander, feeding the work piece under a revolving drum, which is surrounded by sandpaper or other abrasive substances, to reduce the work piece in thickness to the distance between the bottom of the drum and the top surface of the supporting table upon which the work piece rests.

Some woodworkers for the same purpose use a stationary planer, a machine with revolving blades being held above a work piece being fed through it to reduce the work piece in thickness to the distance between the bottom of the blades and the top surface of the supporting table upon which the work piece rests.

These sanding and planing procedures can have satisfactory results if the work piece is not bowed, cupped, crooked, thin or short in length and if the work piece has one surface which is flat.

If the work piece is cupped (i.e., curved on the width dimension) a hold down device on the drum sander or planer will push the work piece down flat on the supporting surface in the process of holding it firm before it is passed through the sander or planer and when the work piece exits the machine, and downward pressure is released, the work piece may return to its cupped shape.

To prevent this, the woodworker has to machine one side of the work piece flat for it to rest squarely on the supporting surface of the machine while the top surface is being sanded or planed. Most woodworkers accomplish this by passing the work piece repeatedly over a jointer, sand or plane the work piece.

Short work pieces should not be passed over jointer blades, through a drum sander or through a planer for such procedure is unsafe. Consequently, to reduce the thickness of a short work piece, and particularly one which is cupped, the woodworker must plane (either manually or with a hand held power planer) and/or sand both surfaces of the work piece It is difficult, by using these methods, to obtain a work piece accurately dimensioned because of the lack of means to control flatness of cut and limit or stop the depth of cut.

A stationary drum sander or planer cannot remove the bow or crook of a work piece; a plane, sander or jointer do not have mechanical means to accurately dimension it and, therefore, to straighten it, the artisan generally must use a saw.

A jointer cannot easily straighten a work piece that is crooked or bowed and may not be able to remove the cup of a work piece if it is thin enough to be flattened when pressure, which is necessary to pass it over the jointer blades, is exerted upon the work piece. A jointer does not have means to control the thickness dimension of the work piece. Furthermore, passing thin stock over jointer blades is considered unsafe by most skilled woodworkers.

It is difficult for a woodworker, without specialized equipment, to obtain a work piece in which the plane of the top surface is not parallel to the plane of the bottom surface. Since drum sanders and planers reduce and dimension the work piece in parallel planes and since it would be difficult, if not impossible, to obtain this result by using a jointer he/she must resort to hand tools. These tools do not, however, provide a controlled means to accomplish this result.

Furthermore, drum sanders, planers and jointers are not easily portable and, being expensive, are not affordable by many woodworkers.

Most woodworkers, therefore, would find it desirable to have a hand held , easily portable, inexpensive sander, mechanically controlled, that could sand the surface of a work piece and to dimension it on any desired plane, straight, consistent and to a depth certain and predetermined.

OBJECTS AND ADVANTAGES

Accordingly, I claim as objects and advantages of the invention described herein: to provide a means to support a hand held sanding tool on an independent supporting structure's surface other than the surface of the work piece being sanded or which object is accomplished by adding fences (or legs, in effect) to the sides of the tool, such fences being adjustable independently or together, up, down, in or out, or on an angle and allows the sander to "straddle" the work piece being sanded in order that the extent and angle of the cut in the work piece can be predetermined and will be governed, limited and stopped at a controlled distance between the abrasive material, at the bottom of the sander, both above the work piece, and the top surface of the supporting structure below the work piece.

In addition, I claim the following additional objects and advantages: to provide a support and stop limiting means to be attached to a hand held sander, either motorized or manually operated, which will be easily transported, requiring minimum skill and training to use, to solve the problems of dimensioning a work piece described above and specifically one that can mechanically and accurately cut and dimension a work piece, short or long, to a consistent predetermined thickness, angle and plane, and one which can also remove the cup, bow or crook of the work piece, machine it to a flat surface, without "valleys" or being "rounded", dimension it in any curve or contour desired and one which will not be laborious to use, since the tool will be handled during the sanding procedure rather than the work piece (which may be heavy, large and/or awkward to handle) and one that will be affordable by the average woodworker.

Readers will find further objects and advantages of the invention from a consideration of the ensuing specifications, and accompanying drawings.

DESCRIPTION OF THE INVENTION AND THE MANNER AND PROCESS OF MAKING AND USING IT

FIGS. describing drawings herein:

FIG. 1 shows a perspective view of the preferred embodiment of the invention, being an orbital hand held sander with adjustable fences on its sides in which spring supported wheels are housed and on which are rules and a gauge to measure the angle and depth of cut of the work piece FIG. 1A shows a perspective view of the sander depicted in FIG. 1 with the fences raised and retracted in the sander's housing FIG. 1B detailed drawing of fence mechanism showing wheels and spring support housed within fences FIG. 1C detailed drawing of the gauge depicted in FIG. 1 to measure in degrees the angle of the fences to the supporting structure FIG. 1D shows a top view of the junction of the supporting arms and fences which allows the fences to be placed on an angle other than perpendicular to the supporting structure FIG. 1E detailed drawing of the rule depicted in FIG. 1 to measure the amount of work piece to be reduced or to set the dimension of the work piece to be obtained after the cutting action is stopped FIG. 2 shows a perspective view of a hand held belt sander with removable and independently adjustable fences FIG. 3 shows a perspective view of a sanding block with adjustable fences supported by bolts FIG. 4 shows a perspective view of a sanding block having fixed fences FIG. 5 shows a perspective view of a manually operated hand sander with adjustable fences FIG. 6 shows one version of a fence which is attachable to a previously manufactured sander FIG. 7 shows a front view of a belt sander and means to tilt the fences and measure the degree of the angled cut to obtain a different plane on the work pieces' top surface than that of the bottom FIG. 7A detailed drawing of fence housing containing solid vertically adjustable fence FIG. 8 hand held drum sander, which is a new tool, incorporating fences and stop mechanism; the motor which powers the tool is contained within the drum FIG. 9 shows a perspective view of a drum sander, which is also a new tool, with fence and stop mechanism FIG. 1 shows a perspective view of an orbital hand held sander 1, in the preferred embodiment of the invention, with adjustable fences 2 on its sides, sanding a work piece 3 flat in a horizontal plane parallel to the horizontal plane of the surface of the supporting structure 21, which, in this instant, is a work table. The sander is being supported by an interim support means inside the fences, wheels 16, shown in detail in FIG. 1B, which results in the sander being supported independently by a structure other than the surface of the work piece being sanded.

The two fences 2, on the sides of the sander 1, straddle the work piece 3. The fences may be adjusted vertically by the use of adjustment mechanism 10 and 20 that controls such movement of the fence supporting arm 5 or horizontally by moving the arms outward from arm housing 23.

Housed inside the fences 2 are wheels 16, as shown in FIG. 1B, on axles 19. The axles are supported in an elongated rectangular frame 18 within the fences connected above to springs 15 which are connected to a support above them 24, which spring unit consists of the springs 15 and a vertically adjustable rectangular frame 24. The sander 1 along with the fence mechanism 2 will go down when downward pressure is exerted upon the top portion of the sander until the abrasive material 4, attached to the bottom of the sander, is in contact with the work piece 3. The purpose of the spring supported wheels 16 is to support the tool 1 on the independent supporting structure's surface, 21, as an interim support while the work piece 3 is being sanded. As the work piece is reduced in size wheels 16 will gradually move upward into the fences 2, and, when the predetermined depth of cut is reached, the sander will be supported by the fences 2 on the independent supporting structure, the work table, rather than the surface of the work piece and the wheels will be fully retracted in the fences.

As shown in FIG. 1B, the rectangular wheel supporting frame 18 can be lowered to allow the tool supporting wheels to rest on the supporting structure's surface 21 by adjusting nut and bolt 14 and allowing the spring unit, springs 15 and supporting frame, 24, to move vertically in groove 17. The distance the wheels are lowered below the bottom of the fences is the same as the amount of cut to be made on the surface of the work piece.

At the top of the machine is a handle 10 which, when turned, turns screw 20 that causes the fence supporting arm housing 23 and supporting arms 5 to be raised or lowered. The handle 10 has vertical grooves around its outer edge. When the desired depth position of the fences has been obtained lock 11, by loosening its screw, can be advanced and the blade like protrusion of the lock can be inserted into one of the vertical grooves of the handle, 10, and then, by tightening the lock's screw, the handle can be prevented from further turning and, consequently, the position of the fences will be fixed. This locking procedure is adequate for normal use; however, for prolonged use the woodworker may want to use the other locking devise provided, bolts 13 through pegs 12.

Screw 20, which is operated by handle 10, is partially threaded to allow it to be turned freely without being raised vertically, so support arm housing 23, through whose threaded hole the screw passes, will move up or down on pegs 12 when screw 20 is rotated.

Four square pegs 12 are attached to the frame of the sander which extend through the fence supporting arm housing 23. The purpose of the pegs is to prevent the axial movement of the arms when screw 20 is rotated, forcing arm housing 23 and supporting arm 5, to move vertically. Also, the pegs prevent the arm from rocking. The pegs have vertical grooves 25 to allow bolts 13 to be inserted through them and fence supporting arm housing 23 and supporting arm 5. As the arms moves vertically, the bolts can also move vertically within the pegs. A nut on the bolt can be tightened to secure the bolt and arms after the desired vertical position of the fence is obtained. It will not be necessary to use handle lock 11 when bolts 13 are used to lock fence supporting housing 23 and supporting arm 5.

The fences are attached to or are an integral part of the sander in such a manner that when work piece 3 is reduced in size sufficiently the fences will come in contact with the supporting structure's surface 21, and thereby prevent the sander from cutting further into the work piece.

When fences 2 do come into contact with the supporting structure, the woodworker can continue moving the sander length wise, back and forth, over the surface of the work piece confident that the sander will not reduce it further than the predetermined distance between the bottom of the fence and the abrasive material 4. The sanding procedure can be continued, with the fences supporting the tool on the contiguous supporting structure's surface 27, rather than the surface of the work piece, and when said work piece is uniformly reduced throughout its length the fences will be in contact with the supporting structure throughout the sanding stroke over the length of the work piece and, since the depth of cut will have been reached, the cut will be stopped and the user will know that the horizontal plane of the top surface of the work piece is parallel to the horizontal plane of the supporting structure 21.

On fences 2 in FIG. 1 are rules 9, as depicted in FIG. 1E, the bottom portion of which are flush with the bottom portion of the fences. This enables a user, prior to sanding, to place the sander 1 upon the work piece 3 and move the fences 2 downward to the desired measured depth of cut which is to be obtained. The measurement of the desired finished dimension of the work piece can be then set. The depth of cut will be limited or stopped when the work piece 3 is reduced to the premeasured distance between the bottom of the fences, point 26, and the bottom of the abrasive material 4 attached to the sander by clip 8.

As a cross check, the measurement of the amount of work piece that will be removed can also be determined by loosening the rule's screws and moving rule 9 downward to supporting structure 21. The extent of cut to be obtained is the distance between the plane of the top surface of supporting structure 21 and the bottom of the fence, points 26 and 27 of FIGS. 1 and 2, for the thickness dimension of the work piece will have to be reduced this amount before the fences will contact supporting structure 21.

Thus the rules allow two measurements: one, the desired thickness dimension of the finished work piece that will be obtained when the sanding action is stopped and/or, two, the measurement of the amount of the work piece which will be removed by the sander before being stopped.

Rule 9 can then be returned so that the bottom of the rule is flush with the bottom of the fence and secured in that position.

FIG. 1A shows a perspective view of the sander depicted in FIG. 1 with the fences raised and retracted in the sander's housing. Before using the sander, bolts 13 of FIG. 1, will be removed and the arms 5 of FIG. 1 will be extended outward to the extent necessary for the fences to be able to straddle the work piece before lowering the arms by the use of handle 10 and screw 20, and the desired outward extension can then be secured by reinserting the bolts.

Figure 1:
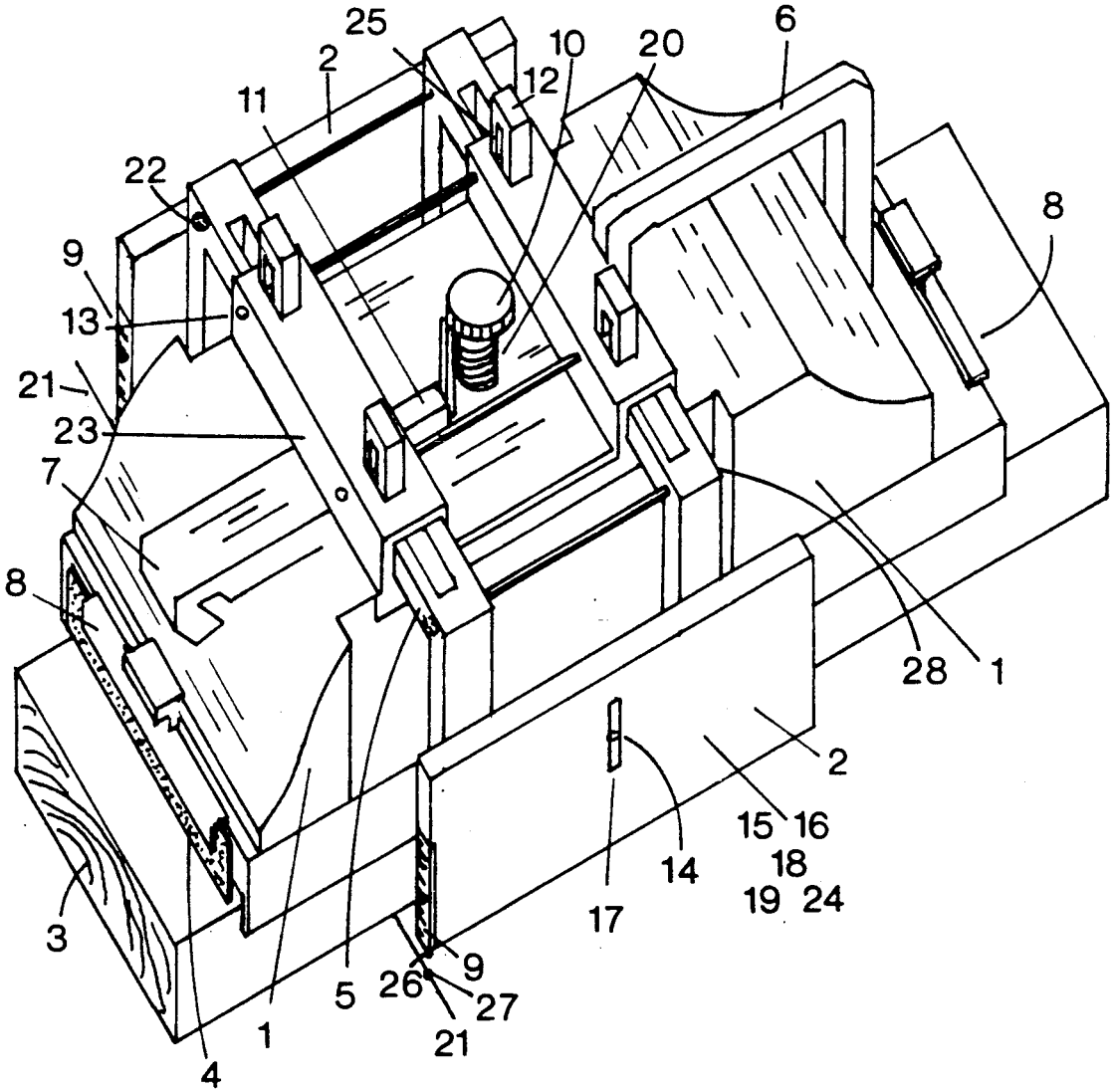
FIG. 1C is a detailed drawing of gauge 22 depicted in FIG. 1 to measure in degrees the angle of the fences to the supporting structure if the fences are not to be perpendicular.
FIG. 1D shows a top view of the junction of the supporting arms and fences, point 28 which allows the fences to be placed on an angle other than perpendicular to the supporting structure.
FIG. 1E shows rule 9 on the end of fence 2 with securing screws.

I will now discuss the method of operating the orbital sander with the fence and stop mechanism as shown in FIGS. 1, 1B, 1C, 1D and 1E.

When a work piece is to be sanded, the woodworker will first lay it upon a table or other supporting structure 21 and may, if he/she desires butt it against a "dog" in the table or secure said work piece on its ends by clamps or other holding devices, being careful not to allow the holding device to be above the plane of the work piece's top surface that will be sanded.

The base of the sander holding abrasive material 4 will be placed upon the top surface of the work piece 3 with the fences 2 extended to be able to straddle and "hang down" on both sides of the sander.

The woodworker will lower fences 2 down along the sides of the work piece 3 by turning handle 10, which causes the rotation of screw 20, and set the fences at the point where he/she wants the abrasive cut to be stopped. The cut will be stopped when the work piece has been reduced to the point where the bottom of the fence comes in contact with supporting structure 21. Therefore, the worker can determine the extent and limit the cut of the work piece and set the stop point by lowering and locking fences 2 after measuring the depth of cut to be obtained by using rule 9, as above described.

Figure 7:
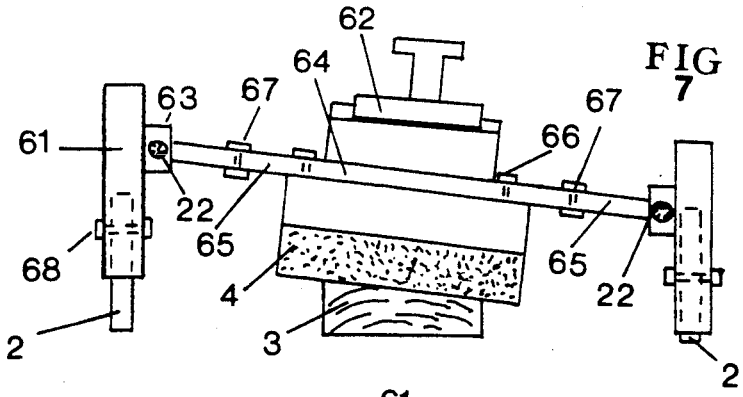

He/She can turn the fences on an angle if the top surface of the work piece is to be sanded on a different plane than the plane of its opposite side, and he/she can measure the degree of the fence's turn by referring to scale 22, as shown on FIGS. 1 and 7.

After fences 2 are in the desired position, movement of handle 10 can be stopped by engaging lock 11, or nuts and bolts 13 which pass through pegs 12 and supporting arm housing 23 and supporting arm 5.

Figures 1A, 1B, 1C, 1D, 1E:
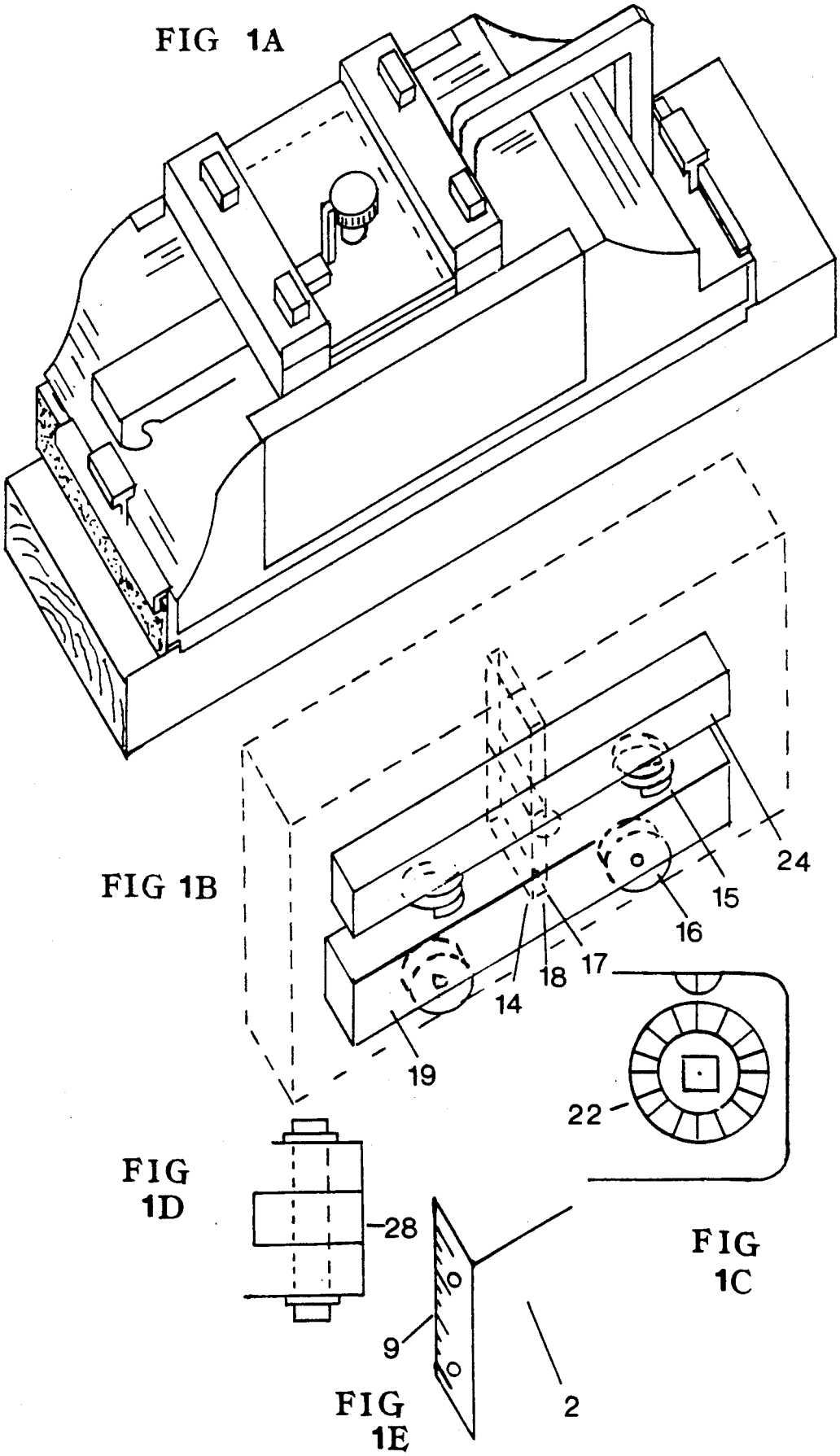

Nut and bolt 14 should then be loosened to allow the spring unit (consisting of the rectangular frame and support base 24 of the springs 15 of FIG. 1B) to be moved downward to the point where the tension of said springs forces interim support wheels 16 into contact with supporting structure 21. This adjustment should be such that when completed the sander is supported by wheels 16 on independent supporting structure 21 and the base of the sander should be flush with the top surface of work piece 3.

The tension of the springs will force wheels 16 of FIG. 1B down below fences 2 to supporting structure 21 and will act as an interim support for the tool while it is cutting work piece 3 until the bottom of fences 2 reach supporting structure 21.

The machine should then be energized. By holding handles 6 and 7 the user will push the sander downward with sufficient force to overcome the tension of springs 15 of FIG. 1B. The sander's abrasive material will contact work piece 3 and wheels 16 of FIG. 1B will gradually retract into fences 2 as work piece 3 is reduced in thickness dimension.

Sander 1 will be moved across the top surface of work piece 3 and the user will continue moving it forward and backward until the desired depth of cut of the work piece is reached, which cut will be mechanically controlled since the cut will be stopped when the bottom of said fences, 2, are in contact with supporting structure 21 throughout the longitudinal dimension of the work piece.

The plane of the top surface of work piece 3 will then be parallel to the plane of the surface of supporting structure 21 if the fences have been set at zero degrees (directly perpendicular to supporting structure 21) or, if he/she has set the fences on an angle, the plane of the top surface of the work piece will be that which has been set by using gauge 22.

FIG. 2 is a perspective view of a hand held belt sander 29, which has removable fences 2 to allow the changing of the continuous belt sandpaper 4 by unloosening bolts 31 or 32. The drawing also shows fences 2 with solid rigid interim support 34, similar to the fence itself, as also shown on FIG. 7A, housed within the supporting fence rather than supporting wheels 16, as shown on FIG. 1 and FIG. 1B. The solid interim support is supported by springs as shown in FIG. 1B. The bottom of the support can be made of plastic or other material to prevent scarring of the surface of supporting structure 21

In this embodiment, the fences can be adjusted independently by the use of bolts 31 which extend through fences 2 at groove 35 for vertical movement and bolts 32 which extend through support arm housing 36 and support arm 33 for horizontal adjustment of the supporting arms 33.

A longer fence support arm 33 can be obtained by sliding one or both sides outward and securing the arm by tightening bolts 32 or by removing supporting arm bar 33 and replacing it with a longer bar to enable the sanding of a wider work piece.

The sander of FIG. 2 will be used in the same manner as the sander of FIG. 1 by holding handles 30 and 37.

Many woodworkers sand a work piece manually by the use of a "sanding block", which is simply a small piece of wood around which the worker holds a piece of sandpaper Some woodworkers place a piece of felt, rubber or other soft substance between the piece of wood and the back of the sandpaper to soften the blow as the block strikes the work piece. There is on the market more fancy inexpensive manufactured "blocks" made of other substances, e.g., a plastic sanding block with clip mechanisms on the ends to secure the sandpaper, which serves the same function but are, perhaps, more convenient. These blocks are generally used to lightly diminish the surface of a work piece but they do not have means to control the depth of cut or stop the sanding action. They do not have means to assure the woodworker that he/she have sanded the work piece uniformly.

FIG. 3 shows a perspective view of a sanding block 38 with another version of a fence 2 and stop which is adjustable in a different manner. Through the block are bolts 39 that extend outward through the fences 2 which, in this instance, are slim vertically supported pieces of wood. Attached by screws to the inside of the fences are 37 L" brackets 40 to support the fences in an upright position, which brackets have holes on one leg through which the bolts pass. Also, inside and outside of the fences on the bolts are nuts and washers 41 and 42 to lock the fences in the outward horizontal position desired by the woodworker. The fences each have a vertical groove 44 through which the bolts pass allowing the fences to be also moved vertically. Sandpaper 4 is held onto and below the block by clips 8.

The wood worker will place the block, with sandpaper 4 annexed and secured by clips 8, on the top surface of the work piece 3 with the fences 2 straddling it. He/she will then move the fences outward to the desired position. The inward nuts 41 will set the fences outward position and the outward nuts 42 will set the fences inward position. Before securing the outward nuts, the woodworker will adjust fences 2 to the desired depth of cut and this vertical position will be secured by tightening outward nuts 42. On this version the fences are separately adjusted which also allows for an angled cut. Although this ramification of the sander with fence and stop mechanism has a handle 45, the tool could be a simple block.

FIG. 4 shows a perspective view of another simple sanding block 46 with fixed permanent fences, the block and fence being all in one piece. The amount of out of this block cannot be varied and will cut a work piece to the tool's certain fixed dimension (as drill bits are made to cut holes of a certain size). The tool has clips 8 to attach sandpaper 4 and the finished work piece 3 will have a thickness dimension equal to the distance between the surface of the said sandpaper and the bottom of said fence 2.

FIG. 5 shows a perspective view of a manually operated hand sander which has adjustable fences and supporting arm 48 combined that can be moved vertically by turning knob or nut 49 on screw 50 that moves the fence supporting arm and fences 48 upward and holds it in that position preventing downward movement. This tool also has clips 8 to secure the sandpaper 4 and handles 53 and 54 for ease of working the tool. Nut and bolt 52 prevent upward movement of the supporting arm and fence 48 and platen 51 when downward pressure is exerted upon the tool. The handles, 53 and 54, also stabilize the fences and act as a guide for movement of the supporting arm and fences 48 and/or the platen 51 holding the sandpaper.

The sanders of FIGS. 3, 4 and 5 will be used in the same manner as the sander shown in FIG. 1, which has been previously described.

Figure 6:
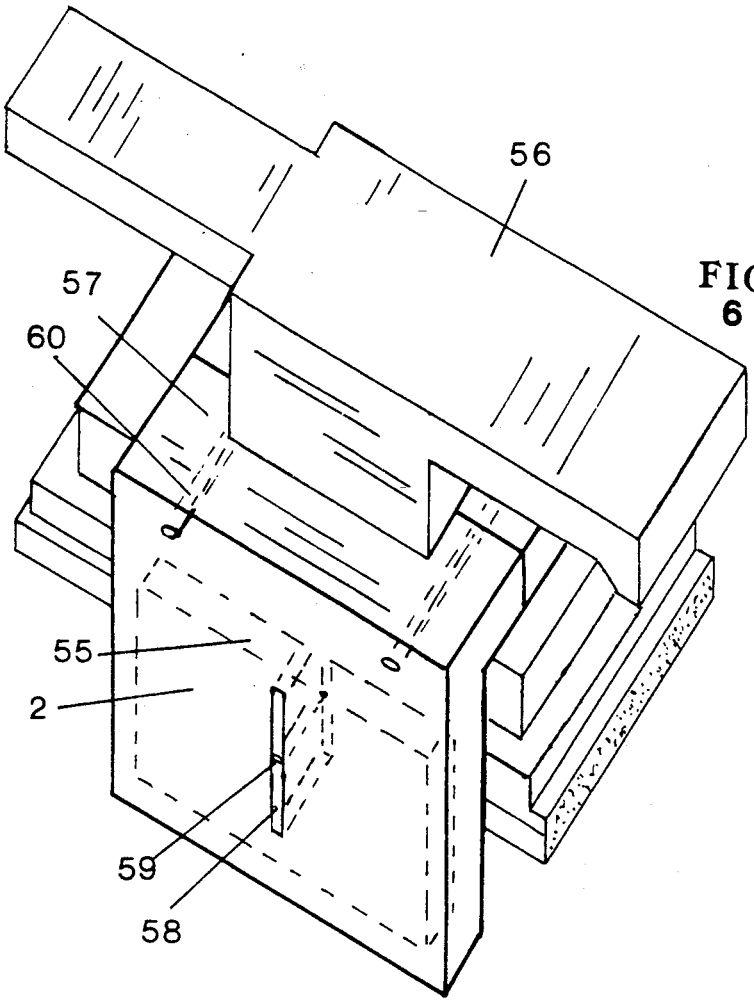

FIG. 6 shows one version of attachable supporting fences 2 made to attach to a sander 56 which, when it was manufactured, did not have a fence or stop mechanism, which detachable fences and supporting arms are shown in bold lines of said FIG. 6. It has two fences 2 housed within two supporting fences 55 secured to arm attachments 57 secured together around the sander 56 by nuts and bolts 60. The fences 2 can be set in various vertical positions by nuts and bolts 59 which slide up or down through vertical groove 58 which is cut through the supporting fence 55.

Figure 7A:
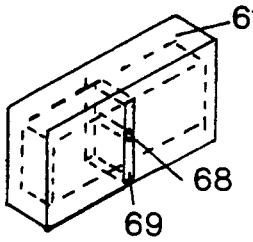

FIG. 7 shows a frontal view of a continuous belt sander 62 similar to that sander depicted in FIG. 2. It has fences 2 inside the outside fence support 61. The top surface of work piece 3 is being sanded on a plane which is not parallel to the plane of the supporting structure. Sandpaper 4 is a continuous belt. Supporting arm housing 64, containing supporting arm 65, can be placed on an angle to allow supporting outside fence support 61, containing fence 2, to remain perpendicular to the supporting structure although the base of sander 62 is not parallel to the surface of said supporting structure. Such independent vertical movement of the fence 2, fence outside support 61 and supporting arm 65 can be accomplished by adjusting the nut, bolt and bracket 63 connecting the fences with the supporting arms. FIG. 7A shows the fences'housing 61 containing solid vertically adjustable fences 2.

Through the supporting arm housing 64 and supporting arm 65 are bolts and nuts 67 to secure the horizontal position of supporting arm 65 which are necessary since the arms are extended beyond the frame of the sander and the bolts cannot be secured to the frame of the sander.

The sander contains a scale 22 in degrees to regulate the angle of cut of the work piece which is depicted in FIG. 1C. After arms 65 are adjusted to the desired angle of cut, indicated on scale 22, the bolt and nut 63 can be tightened.

As depicted in FIG. 7A, the vertical position of fences 2 inside the outside supporting fence 61 can be adjusted by nut and bolt 68 which passes through the vertical groove 69 which is cut through the outside supporting fence 61 and the fence within, 2.

Various features are not shown on all Figure drawings depicting the tools, but, obviously, any feature on one tool can be incorporated in another.

Figure 8:
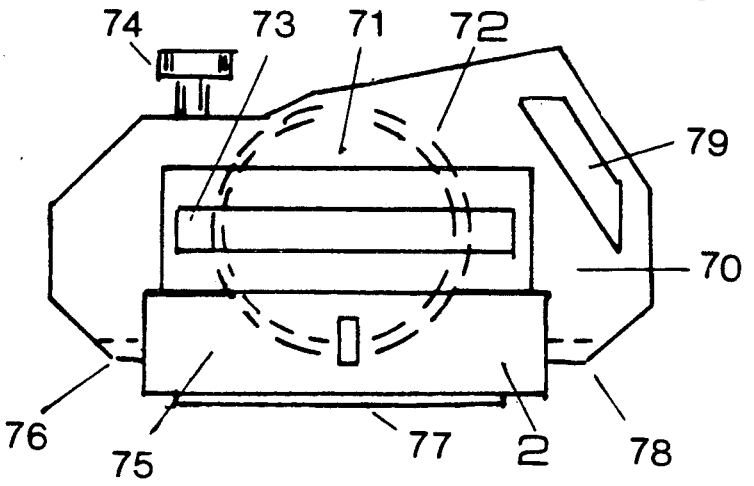
Figure 9:
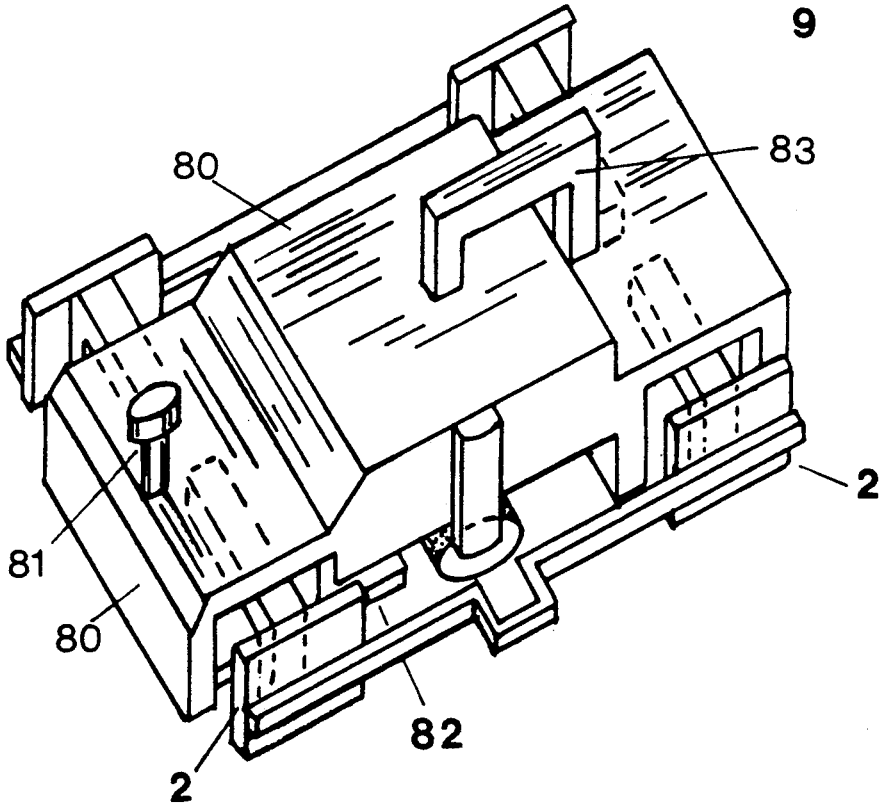

The cutting tool on all figures shown herein could be a hand held plane, a hand held powered plane, an orbital sander, a belt sander or sanding block and my claim, to support a cutting tool on the surface of an independent structure other than the surface of the work piece being cut, by using fences on the sides of the cutting tool to create a means to limit the cut of the work piece and act as a stop, is not restricted to the tools described or depicted in drawings herein but does specifically apply to all hand held sanders, which cut a work piece by the movement of abrasive material or substance over the surface of a work piece. FIG. 8 shows a side view of a tool on which this applicant will shortly file an application for letters patent that incorporates the fence mechanism 2, for purposes of a stop and depth of control, claimed herein. The drawing and the drawing of FIG. 9 are included to show that the means of providing a stop and depth control for hand held sanding tools are not limited to the sanders depicted herein or in use today but creates possibilities for new tools. The hand held powered drum jointer/thickness sander 70, with its electric motor 71 housed within the drum 72 supported by cross arms 73 with abrasive material on the drum, will perform the work of a stationary jointer or sander but has many advantages over the larger stationary machines which will be enunciated and illustrated in the patent application. Handle 74 adjusts infeed table 76 vertically. The tool has an interim fence 77, rear handle 79 and outfeed table 78.

FIG. 9 shows a perspective view of a portable drum sander 80 with fence and stop mechanism 2 whose motor is not within the drum although the motor, like the tool in FIG. 8, can be placed in the drum to obtain a very compact tool. The sander has a rear handle 83 and infeed table 82, which table is adjustable vertically by front handle 81. Fences 2 retract in the housing when not in use An application for letters patent on this tool will also be filed by applicant herein.

I have included herein drawings of many ramifications of a fence and stop mechanism for sanders which are illustrative only and are not by way of limitation for the principle objective is the same, i.e., by having a hand sander supported by fences on an independent structure rather than the tool being supported by the base resting on the surface of the work piece being cut the cut of the work piece will follow in a parallel plane the plane of the supporting structure rather than the contour of the surface of the work piece. Therefore, my claims are not restricted to the particular means to so support the tool as shown in various figure drawings herein, nor are my claims restricted to that particular tool.

I have included only one version of an attachable fence and stop mechanism for a previously manufactured tool. Manufacturers can design and sell many attachable fences to specifically fit each such tool and an artisan could purchase such an attachment in order to be able to control and stop the cut of any tool he/she may now own.

While the above descriptions contain many specificities, the reader should not construe these as limitations on the scope of the invention, but merely as exemplications of preferred embodiments thereof. Those skilled in the art will envision many other possible variations that are within its scope. For example, skilled artisans will readily be able to change the dimensions and shapes of the various embodiments. They can make the fence and stop mechanism from any rigid materials, such as plastic, medal or wood. They can make many variations on the fence adjustment mechanisms. They can make the tool with or without interim supports, which support the sander while the work piece is being sanded, and skilled artisans can devise other temporary supports to support the tool until it reaches its predetermined depth of cut. The interim support inside the fences could be of solid rigid material similar to the fence itself of FIG. 2 or wheels shown in FIG. 1A.

If the tool is made without interim supports, its base will "ride" the surface of the work piece until the fences contact the supporting structures and, at that point, the fences will support the tool on such structure preventing further cutting of the work piece. Manufacturers can make the fences non-adjustable and set for a particular depth of cut and supply a plurality of sanders or fences and, in particular, manually operated block sanders with such different pre-set means to control the depth of cut.

Skilled artisans could make sanders with fences supported by supporting structures from above the work piece. They can make supporting structures which are not on a horizontal plane and which are not straight on the longitudinal dimension. They can clamp curved templates on the sides of the work piece to act as supporting structures so that when the work piece has been sufficiently reduced for the fences to contact the templates the contour of the work piece will be in parallel to the contour of the template. Unlimited jigs can be constructed to secure the work piece, the supporting structures and the fences. Fences could be mounted in a manner to be turned on an angle to the base of the tool with a scale measured in degrees to show the angle.

Artisans can construct fence supporting arms of longer length or supporting frame structures which will enable the tool to move four ways over a wider width dimension in order to cut a wider work piece. Skilled woodworkers could construct a sander with a curved detachable base, or sole, which sander, or plane, with fences attached, would not be restricted to the support, contour or plane of the work piece and could produce curved work pieces, e.g., wood moldings. The fences can be formed by extrusion and machining so that they are a one piece unit with a U-shaped cross-section, when seen from the tool's tip. In fact, they can provide many types of protrusions, fences or means attached to a sander, or made an integral part thereof, to function in the manner described herein to limit the depth of cut which the tool can make in the direction perpendicular or on an angle to its side cutting edge which protrusion or means will act as a stop, preventing the tool from cutting past a predetermined point by the protrusion coming in contact with an independent supporting structure or by other means, including electronic means, and/or sensor devices, stopping the tool's cutting action when a predetermined depth of cut has been obtained.

It will be seen from the foregoing description that I have provided a hand held sander, either motorized or manually operated, and fence and stop attachments for previously manufactured tools, that enables a new or old sander to cut a work piece to a controlled depth and angle of cut and to stop and limit said cutting action when the predetermined thickness dimension of the work piece has been attained.

Accordingly, the reader is requested to determine the scope of the invention by the appended claims and their legal equivalents and not by the examples which have been given.

What I claim as new and desire to secure by letters patent is:

1. A portable sander for performing an abrasive cut of a wood work piece to a predetermined depth and angle of cut comprising:

(a) a rigid frame including a base member, (b) attached abrasive material to said base member, (c) retractable means, comprised of rigid parts, attached to the sander and extending downward from said base member of the sander, which said retractable means support the sander on the surface of an independent supporting structure rather than the surface of the work piece while the work piece is being cut, and (d) a fence means, comprised of rigid parts, that are attached to the sander and extend downward from said base member and straddle the work piece to control, limit and stop the abrasive cut of the top surface of said wood work piece when the work piece has been reduced to a predetermined dimension and portions of said fence means contact the independent supporting structure and support the sander above the top surface of the work piece.

2. The sander of claim 1 wherein said retractable means and said fence means are attached to adjustable supporting arms extending outward from the sander, said supporting arms being adjustable vertically, horizontally and to an angle certain from the supporting structure of the tool to enable the sander to cut wood work pieces of various widths to a predetermined depth and angle of cut.

3. The sander of claim 1 wherein the said fence means comprise ruling devices for the user to determine and fix the position of the fences in a manner necessary to obtain a desired measured depth of cut of the work piece when the abrasive cut of the sander is stopped by the fences.

4. The sander of claim 1 comprising means to move or rotate the fences to a measured angle, that is not perpendicular to the base of the sander, so as to obtain a cut of the top surface of the work piece that is not parallel to the plane of the bottom surface of said work piece.

5. The sander of claim 1 wherein said portable wood sander is an orbital sander.

6. The sander of claim 1 wherein said portable wood sander is a belt sander.

7. The sander of claim 1 wherein said portable wood sander is a drum sander.

* * * * *